US009175504B2

(12) United States Patent
Wong

(10) Patent No.: US 9,175,504 B2
(45) Date of Patent: Nov. 3, 2015

(54) MECHANICAL COMBINATION LOCK

(71) Applicant: BORG LOCKS (HK) LTD, Hong Kong (HK)

(72) Inventor: Ngai Kwong Wong, Hong Kong (HK)

(73) Assignee: BORG LOCKS (HK) LTD, Hong Kong (HK)

( * ) Notice: Subject to any disclaimer, the term of this patent is extended or adjusted under 35 U.S.C. 154(b) by 0 days.

(21) Appl. No.: 14/297,704

(22) Filed: Jun. 6, 2014

(65) Prior Publication Data

US 2015/0000355 A1 Jan. 1, 2015

Related U.S. Application Data

(60) Provisional application No. 61/839,394, filed on Jun. 26, 2013.

(51) Int. Cl.
*E05B 37/16* (2006.01)
*E05B 37/00* (2006.01)

(52) U.S. Cl.
CPC ..... *E05B 37/166* (2013.01); *E05B 37/0058* (2013.01); *E05B 37/16* (2013.01); *Y10T 70/7181* (2015.04)

(58) Field of Classification Search
CPC ..... E05B 37/16; E05B 37/02; E05B 37/166; E05B 13/103; E05B 37/163
USPC ..... 70/214, 288, 291, 292, 294, 301, 302, 70/303 A, 303 R, 304–311, 320–323
See application file for complete search history.

(56) References Cited

U.S. PATENT DOCUMENTS

| | | | | | |
|---|---|---|---|---|---|
| 1,452,503 | A * | 4/1923 | Grubb | 70/306 |
| 3,040,556 | A * | 6/1962 | Rosenhagen | 70/315 |
| 3,115,765 | A * | 12/1963 | Fengler | 70/315 |
| 3,616,667 | A * | 11/1971 | McGourty | 70/285 |
| 3,777,519 | A * | 12/1973 | Germanton | 70/220 |
| 3,832,873 | A * | 9/1974 | Barnette | 70/291 |
| 4,027,508 | A * | 6/1977 | McGourty | 70/214 |
| 4,111,017 | A * | 9/1978 | Barnette | 70/293 |
| 4,350,031 | A * | 9/1982 | Shimono | 70/315 |
| 4,476,698 | A * | 10/1984 | Treslo | 70/25 |
| 4,732,020 | A * | 3/1988 | Pieddeloup | 70/305 |
| 4,848,116 | A * | 7/1989 | Lizotte | 70/306 |
| 5,018,405 | A * | 5/1991 | Chiu | 74/529 |
| 6,000,254 | A * | 12/1999 | Raybary | 70/214 |
| 6,026,665 | A * | 2/2000 | Raybary | 70/214 |
| 6,298,698 | B1 * | 10/2001 | Nakajima et al. | 70/214 |
| 6,575,004 | B2 * | 6/2003 | Berton et al. | 70/313 |
| 7,316,139 | B2 * | 1/2008 | Nakazima et al. | 70/214 |
| 7,581,417 | B1 * | 9/2009 | Chen | 70/57 |
| 8,555,686 | B2 * | 10/2013 | Meekma et al. | 70/320 |

(Continued)

*Primary Examiner* — Suzanne Barrett

(57) ABSTRACT

The present application is directed to a mechanical combination lock which includes a base having a cavity, a central shaft provided inside the cavity, and a plurality of combination control units provided on the central shaft, wherein each combination control unit includes a combination disc having at least three combination regions that correspond respectively to different combination conditions. The present application provides the mechanical combination lock whereby one button can set a combination with 2 or more bits. That means repeating characters can appear in a combination sequence. This can greatly increase the complexity of the combination sequence and can prevent cracking of the combination sequence without increasing the number of buttons on the mechanical combination lock.

9 Claims, 10 Drawing Sheets

(56) References Cited

U.S. PATENT DOCUMENTS

| | | | | |
|---|---|---|---|---|
| 8,973,418 | B2 * | 3/2015 | Graham | 70/322 |
| 2003/0205069 | A1 * | 11/2003 | Knoll | 70/26 |
| 2004/0261477 | A1 * | 12/2004 | Wang | 70/214 |
| 2007/0144226 | A1 * | 6/2007 | Miao | 70/214 |
| 2011/0132049 | A1 * | 6/2011 | Meekma et al. | 70/314 |
| 2014/0305018 | A1 * | 10/2014 | Horanoff | 42/70.11 |

* cited by examiner

MECHANICAL COMBINATION LOCK

CROSS REFERENCES TO RELATED APPLICATION

This application claims the benefit of U.S. Provisional Patent Application No. 61/839,394 filed on Jun. 26, 2013; the contents of which is hereby incorporated by reference.

FIELD OF THE TECHNOLOGY

The present application relates to a combination lock, and particularly to a mechanical combination lock.

BACKGROUND

In existing mechanical push button combination locks, each button can only set a 1-bit combination. That means repeating characters would not appear in a combination sequence. For example, for a combination lock having 9 buttons that correspond to numbers 1-9 respectively, the button that corresponds to the number "1" can only set a 1-bit combination "1". That means only one "1" can appear in a combination sequence of the combination lock. When there is a need to set a complicated combination, such as the appearance of "11" in a combination sequence, more buttons will have to be provided to achieve it. This increases the size of the combination lock and results in an increase of the cost of the combination lock.

SUMMARY

One object is to provide a mechanical combination lock whereby one button can set a combination with 2 or more bits. That means repeating characters can appear in a combination sequence. For example, for the button that corresponds to the number "1", one can set a 1-bit combination "1", or one can set a 2-bit combination "11". This can greatly increase the complexity of the combination sequence and can prevent cracking of the combination sequence without increasing the number of buttons on the mechanical combination lock.

The mechanical combination lock includes a base having a cavity, a central shaft provided inside the cavity, and a plurality of combination control units provided on the central shaft, wherein each combination control unit includes a combination disc having at least three combination regions that correspond respectively to different combination conditions.

The combination control unit may further includes a bottom seat and a coupling member both mounted on the central shaft, first and second combination control discs being mounted on the bottom seat, and first and second return springs for the resetting of the first and second control discs respectively, and wherein the combination disc is coupled the coupling member, and the first combination disc and the coupling member are coupled and rotatable together.

One side of the coupling member may be formed with a protruding block for engagement with the combination disc, and the protruding block may be selectively engageable with one of the three combination regions so that the combination disc is disposed in corresponding combination condition.

The cavity may be further provided with a control plate including a plurality of switching teeth, and each of the switching teeth corresponds to a control notch formed at a peripheral portion of the combination disc of one of the combination control units, and wherein the combination lock is in an unlocked condition when each of the switching teeth is aligned with the corresponding control notch, and the combination lock is in a locked condition when at least one of the switching teeth is offset with respect to the corresponding control notch.

The first combination control disc may have three positioning recesses formed along a periphery thereof, one side of the first combination control disc facing the second combination control disc is formed with a position-limiting rod, the other side of the first combination control disc is formed with a connecting block for connection with the coupling member, and the first combination control disc is formed with a first swinging portion.

The second combination control disc may have an arc-shaped position-limiting notch formed at a periphery thereof, the position-limiting rod is located within the arc-shaped position-limiting notch, and the second combination control disc is formed with a second swing portion.

A reset plate may be provided inside the cavity, one side of the reset plate is provided with a positioning languet formed with a plurality of positioning paws, each of the positioning paws corresponds to the first control disc of one of the combination control units, and each of the positioning paws is engageable with one of the positioning recesses of the corresponding first combination control disc.

A camshaft may be further provided inside the cavity, and a plurality of button units may be provided above the camshaft and each button unit corresponds to one of the combination control units.

The button unit may include a driving cam and a driving cam return spring, and the driving cam is formed with a cam portion for pushing the first and second swinging portions.

The button unit may further include a driving fork provided between an internal member and the driving cam, the driving fork is engaged with a recess formed on the driving cam, the internal member is mounted at an upper end of the driving fork, a button cap is mounted on top of the internal member, and a button spring is coupled with a cylindrical portion of the internal member.

BRIEF DESCRIPTION OF THE DRAWINGS

Specific embodiments of the mechanical combination lock will now be described by way of example with reference to the accompanying drawings wherein.

DETAILED DESCRIPTION

Figure 1A:
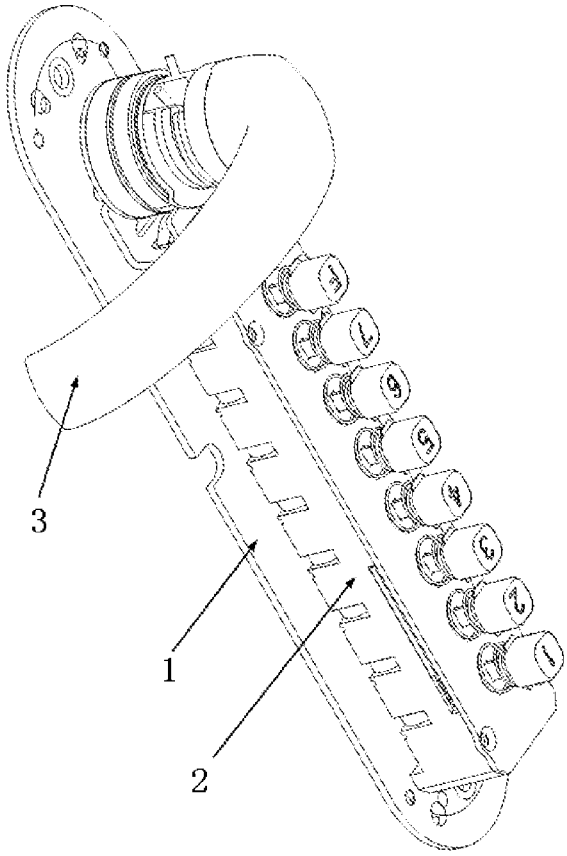
FIG. 1*a* is a perspective view of a mechanical combination lock according to an embodiment of the application.
Figure 1B:
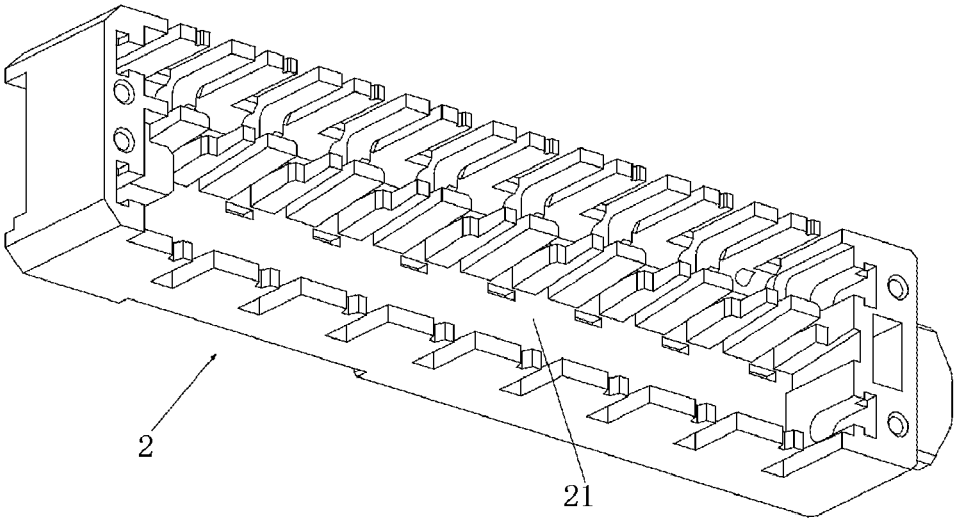
FIG. 1*b* is a perspective view of the base of the mechanical combination lock according to an embodiment of the application.

Reference will now be made in detail to a preferred embodiment of the mechanical combination lock, examples of which are also provided in the following description. Exemplary embodiments of the mechanical combination lock are described in detail, although it will be apparent to those skilled in the relevant art that some features that are not particularly important to an understanding of the mechanical combination lock may not be shown for the sake of clarity.

Furthermore, it should be understood that the mechanical combination lock is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure and appended claims.

In addition, improvements and modifications which may become apparent to persons of ordinary skill in the art after reading this disclosure, the drawings, and the appended claims are deemed within the spirit and scope of the protection.

For illustration purposes, the terms "front", "rear", "top", "bottom", "upper", "lower", "above", "below" appeared hereinafter relate to the invention as it is oriented in the drawings. It is understood that the invention may assume various positions, except where expressly specified to the contrary. Furthermore, it is understood that the specific devices shown in the drawings, and described in the following description, are simply exemplary embodiments of the invention. Hence, specific dimensions and other physical characteristics related to the embodiments disclosed hereinafter are not to be considered as limiting. Furthermore, the terms "first" and "second" are used for description purposes, and should not be considered as an indication or implication of relative importance.

It should be noted that throughout the specification and claims herein, when one element is said to be "coupled" or "connected" or "engaged" with another, this does not necessarily mean that one element is fastened, secured, or otherwise attached to another element. Instead, the term "coupled" or "connected" or "engaged" means that one element is either connected directly or indirectly to another element or is in mechanical or electrical communication with another element.

As used herein, the term "combination" means a set or series of numbers, or letters, or characters; and the term "bit" means number, or letter, or character.

FIGS. 1*a* to 3 show a mechanical combination lock according to an embodiment of the present application. The mechanical combination lock may include a bottom plate 1, a base 2, and a handle 3. The base 2 can be disposed on top of the bottom plate 1. The base 2 can provide a cavity 21 for accommodating therein the parts of the combination lock. A camshaft 4, a central shaft 5, a reset plate 6, a control plate 7, a plurality of button units 8 and a plurality of combination control units 9 may be provided inside the cavity 21. The camshaft 4 and the central shaft 5 can be disposed side-by-side and parallel to each other. The reset plate 6 can work together with the combination control units 9, and can be used for the positioning of the combination control units 9. The control plate 7 can work together with the combination control units 9. When the combination control units 9 are in a locked condition, the movement of the control plate 7 is limited by the combination control units 9, the control plate 7 will thus be in a locked condition. When the combination control units 9 are in an unlocked condition, the control plate 7 can be moved and unlocking of the lock can be achieved. Each button unit 8 may correspond to one combination control unit 9. The button unit 8 can be used to operate the combination control unit 9 that corresponds to the button unit 8.

FIGS. 4*a* to 7*b* show the button unit 8 according to an embodiment of the present application. The button unit 8 may include a driving cam 80, a driving cam return spring 81, a driving fork 82, an internal member 83, a button cap 84 and a button spring 85. The driving cam 80 can be mounted on the camshaft 4. The driving cam 80 may be formed with a cam portion 800. When the driving cam 80 is pushed by the driving fork 82, the driving cam 80 can rotate around the camshaft 4 within a predetermined range of rotation. The driving cam return spring 81 can be a torsion spring and can be used for returning the driving cam 80 to its default position (resetting of the driving cam 80). The driving fork 82 can be located between the driving cam 80 and the internal member 83. The lower end of the driving fork 82 can be formed with a notch 821. The driving cam 80 can be provided with a recess 801 for joining with the notch 821. The notch 821 can engage with the recess 801. The internal member 83 can be mounted on an upper end of the driving fork 82. The button cap 84 can be mounted on the internal member 83. The button spring 85 can be coupled to a cylindrical portion at a lower end of the internal member 83. The button spring 85 can be used for returning the internal member 83 and the button cap 84 to their default position (resetting of the internal member 83 and the button cap 84). When the button cap 84 is pressed downwards, the button cap 84, the internal member 83 and the driving fork 82 move downwards. The driving fork 82 rotates the driving cam 80 to a predetermined angle. When the external force applied on the button cap 84 is released, the button cap 84 and the internal member 83 move upwards under the action of the button spring 85, and return to the position before the pressing of the button cap 84. Under the action of the driving cam return spring 81, the driving cam 80 returns to the position before it is rotated, thereby pushing the driving fork 82 back to the position before the button cap 84 is pressed.

FIGS. 4*a* to 7*b* show the combination control unit 9 according to an embodiment of the present application. The combination control unit 9 may include a bottom seat 90, a first combination control disc 91, a first return spring 92, a second combination control disc 93, a second return spring 94, a coupling member 95 and a combination disc 96. The bottom seat 90 may be mounted on the central shaft 5. The bottom seat 90 may be in the form of a stepped cylindrical sleeve. The bottom seat 90 may include a circular base portion 900, a first cylindrical portion 901 extending outwardly from one side of the circular base portion 900, and a second cylindrical portion 902 extending outwardly from one side of the first cylindrical portion 901. The diameter of the circular base portion 900 can be larger than the outer diameter of the first cylindrical portion 901. The outer diameter of the first cylindrical portion 901 can be larger than the outer diameter of the second cylindrical portion 902. The second combination control disc 93 may be mounted on the first cylindrical portion 901. The first combination control disc 91 may be mounted on the second cylindrical portion 902. The second combination control disc 93 can be held between the first combination control disc 91 and the circular base portion 900. The second return spring 94 may be in the form of a torsion spring. One end of the second return spring 94 can be coupled to the second combination control disc 93, and the other end of the second return spring 94 can be coupled to the first combination control disc 91 so that the second combination control disc 93 can follow the first combination control disc 91.

The periphery of first combination control disc 91 may be formed with three positioning recesses, namely a first positioning recess 911, a second position recess 912 and a third positioning recess 913, for the position of the first combination control disc 91. The periphery of the first combination control disc 91 may be formed with another recess 914 for receiving one end of the second return spring 94. The side of the first combination control disc 91 facing the second combination control disc 93 may be provided with a position-limiting protruding rod 915 for engaging with the second combination control disc 93. The other side of the first combination control disc 91 may be provided with one or more protruding blocks 916 for coupling with the coupling member 95. The first combination control disc 91 can be formed with a first swinging portion 917. When the driving cam 80 is rotated, the cam portion 800 of the driving cam 80 can drive the first swinging portion 917 and hence rotate the first combination control disc 91. The periphery of the second combination control disc 93 may be formed with an arc-shaped position-limited notch 931. The position-limiting protruding rod 915 of the first combination control disc 91 can be located within the notch 931 and moveable therealong. A second swinging portion 932 may be formed on a periphery of the second combination control disc 93. When the driving cam 80 is rotated, the cam portion 800 of the driving cam 80 can drive the portion 932 and hence rotate the second combination control disc 93. The second combination control disc 93 can be formed with a positioning opening 933 for receiving one end of the second return spring 94. One end of the second return spring 94 can be disposed inside the positioning opening 933, and the other end of the second return spring 94 can be coupled to the position-limiting protruding rod 915 of the first combination control disc 91.

Figure 7A:
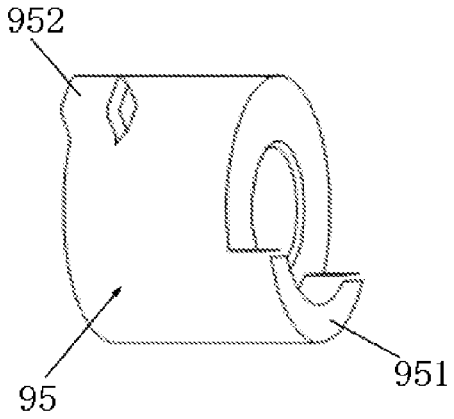
FIG. 7*a* is a perspective view of the coupling member of the combination control unit.
Figure 7B:
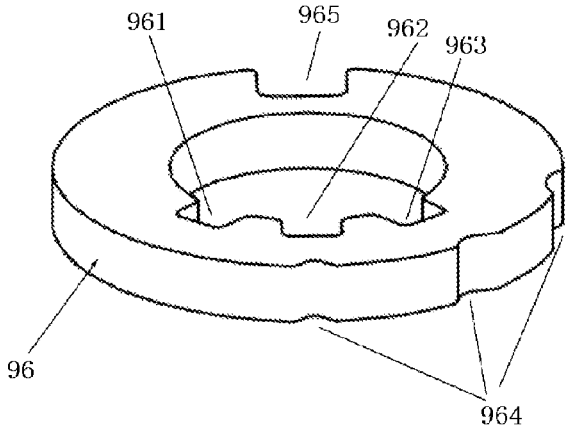
FIG. 7*b* is a perspective view of the combination disc of the combination control unit.

As illustrated in FIGS. 7*a* and 7*b*, the coupling member 95 may be in the shape of a cylinder. The coupling member 95 can be mounted on the central shaft 5. One side of the coupling member 95 may be provided with a semi-circular portion 951 for coupling with the protruding connection blocks 916 of the first combination control disc 91. The first combination control disc 91 can drive the coupling member 95 to rotate together by the protruding connection blocks 916 so as to realize the purpose of combination setting and rotating of the combination disc 96. The other side of the coupling member 95 may be provided with a protruding block 952 for coupling with the combination disc 96. The combination disc 96 can be mounted on the coupling member 95. An inner periphery of the combination disc 96 may be provided with three combination portions. The three combination portions may be in the form of three notches, namely a first combination notch 961, a second combination notch 962 and a third combination notch 963, formed on the inner periphery of the combination disc 96. The first combination region 961 may correspond to a "non-combination" condition, the second combination region 962 may correspond to a "1-bit combination" condition, and the third combination region 963 may correspond to a "2-bit combination" condition. When the protruding block 952 of the coupling member 95 is located in one of the combination portions, the combination control unit 9 is in a condition that corresponds to that one combination region. For example, when the protruding block 952 is located in the second combination region 962, the combination control unit 9 is in a "1-bit combination" condition. When the protruding block 952 is located in one of the combination regions, the coupling member 95 and the combination disc 96 rotate together. When the protruding block 952 is released from the combination region, the coupling member 95 can rotate independently. The periphery of the combination disc 96 may be formed with three indication recesses 964 for the setting of an initial combination. For example, initial combination can be set at the time when the mechanical combination lock is manufactured. A control notch 965 can be formed on the periphery of the combination disc 96. The control notch 965 can be coordinated with the control plate 7. The control plate 7 may include a plurality of switching teeth 71. Each switching tooth 71 may correspond to one combination control unit 9. Specifically, each switching tooth 71 may correspond with one combination disc 96. When all of the control notches 965 of the combination disc 96 are aligned with the switching teeth 71 of the control plate 7, the control plate 7 can be moved in a direction of the arrangement of control notch 965. The switching teeth 71 of the control plate 7 can pass through the control notches 965 of the combination discs 96. When the control notch 965 of any one of the combination disc 96 is not aligned its switching tooth 71, i.e. the position of the control notch 965 is offset with respect to the position of the switching tooth 71, the movement of the switching tooth 71 is restricted and the control plate 7 cannot be moved. Thus, the combination lock is in a locked condition.

Figure 2A:
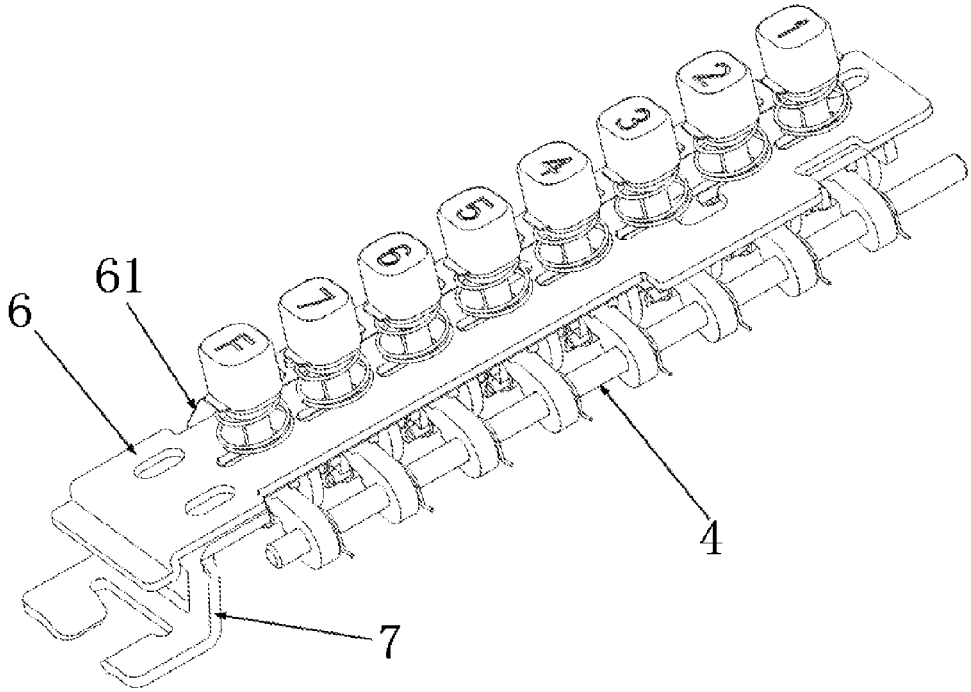
FIG. 2*a* is a perspective view of the internal structure of the mechanical combination lock according to an embodiment of the application.
Figure 2B:
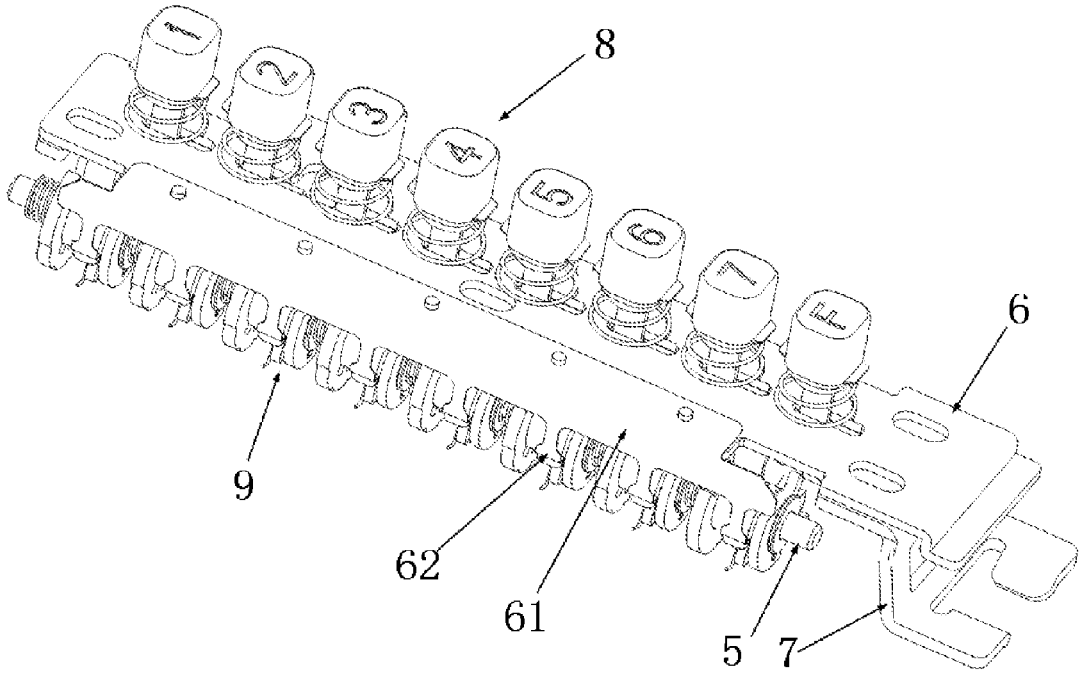
FIG. 2*b* is another perspective view of the internal structure of the mechanical combination lock according to an embodiment of the application.
Figure 3:
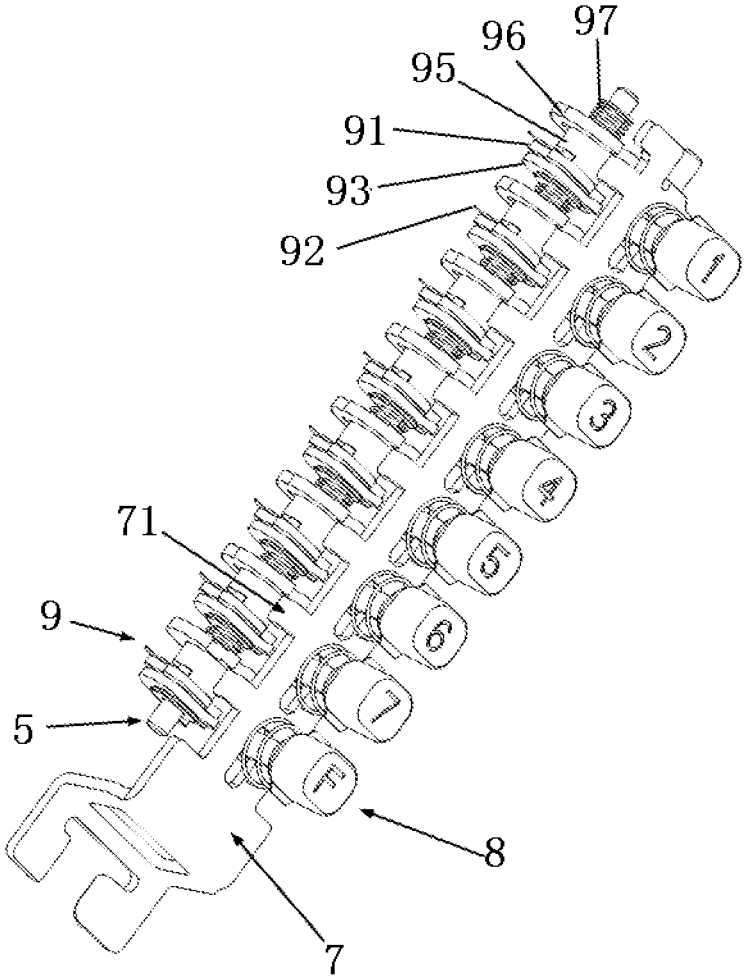
FIG. 3 is a perspective view of the internal structure of the mechanical combination lock of FIG. 2*b* with the reset plate removed.
Figure 4A:
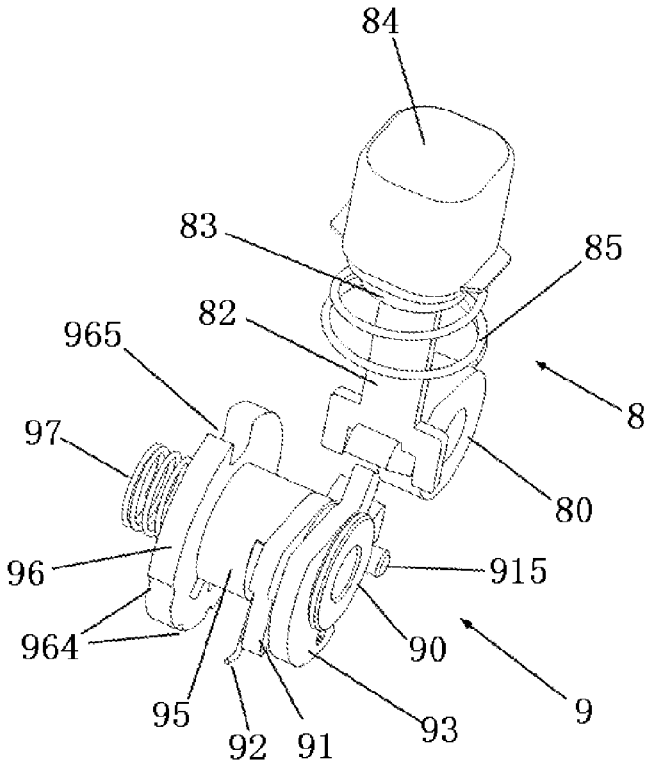
FIG. 4*a* is a perspective view of the combination control unit and the button unit of the mechanical combination lock according to an embodiment of the application.
Figure 4B:
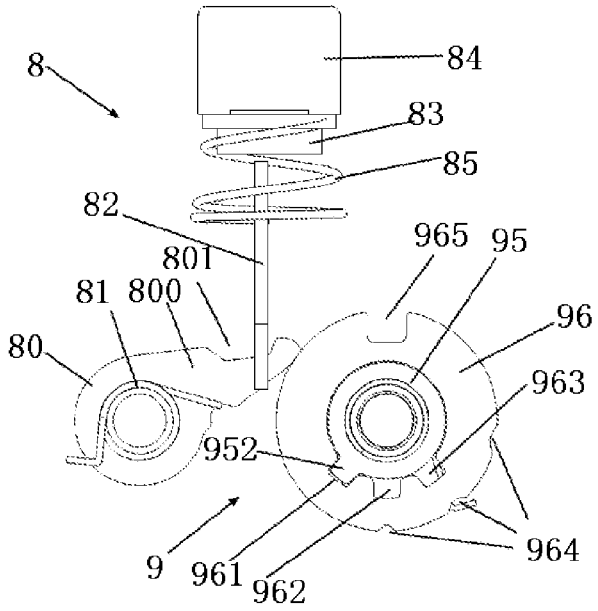
FIG. 4*b* is a left side view of the structure shown in FIG. 4*a*.
Figure 4C:
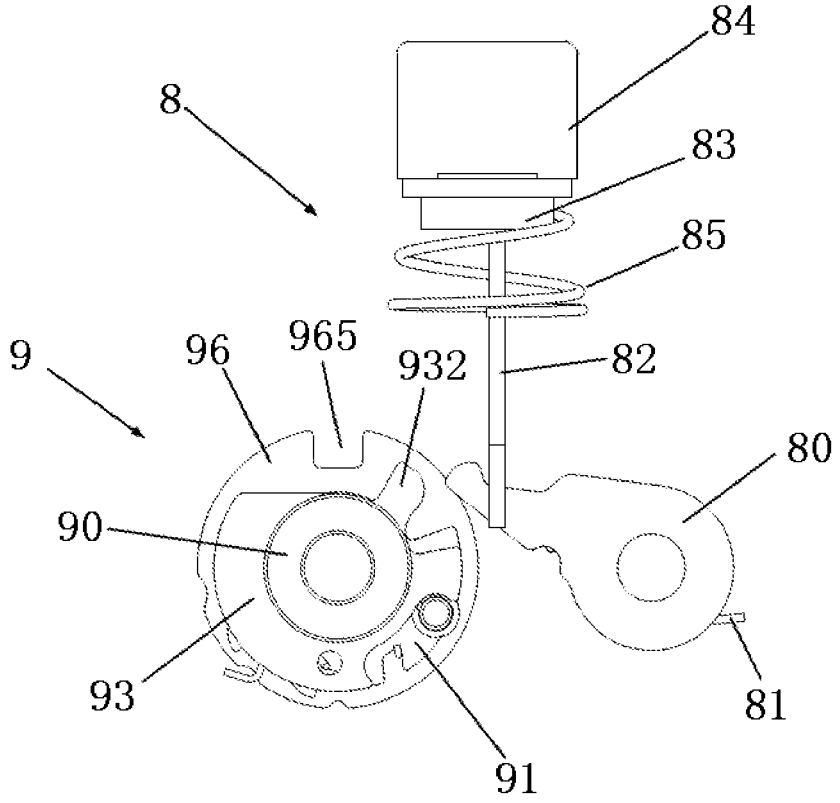
FIG. 4*c* is a right side view of the structure shown in FIG. 4*a*.
Figure 5A:
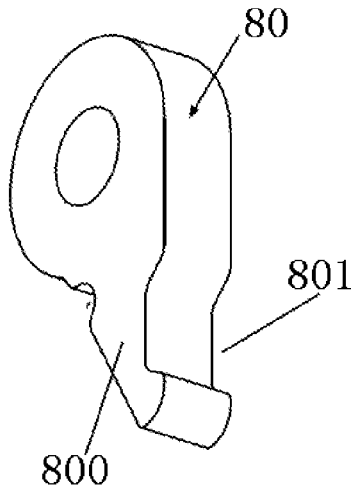
FIG. 5*a* is a perspective view of the driving cam of the button unit.
Figure 5B:
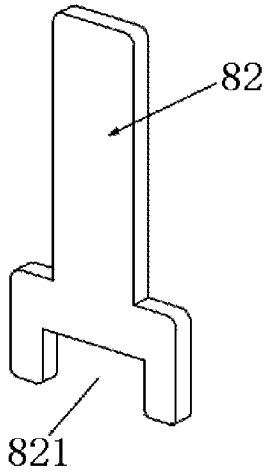
FIG. 5*b* is a perspective view of the driving fork of the button unit.
Figure 5C:
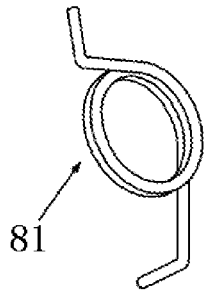
FIG. 5*c* is a perspective view of the return spring of the driving cam of the button unit.
Figure 6A:
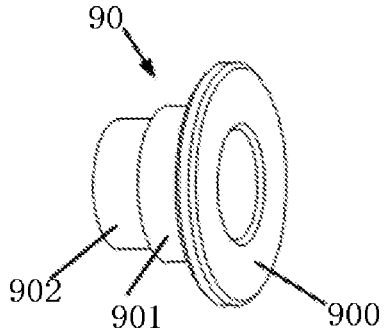
FIG. 6*a* is a perspective view of the bottom seat of the combination control unit.
Figure 6B:
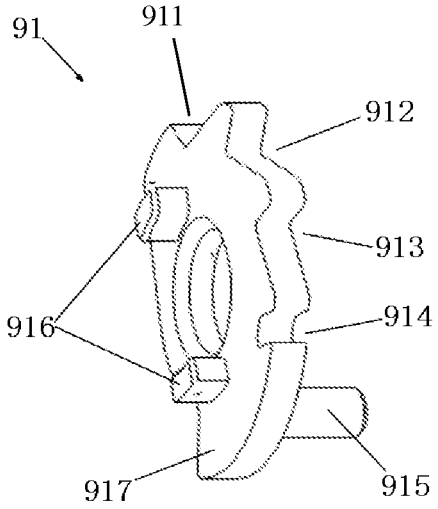
FIG. 6*b* is a perspective view of the first combination control disc of the combination control unit.
Figure 6C:
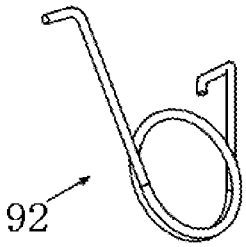
FIG. 6*c* is a perspective view of the return spring of the first combination disc of the combination control unit.
Figure 6D:
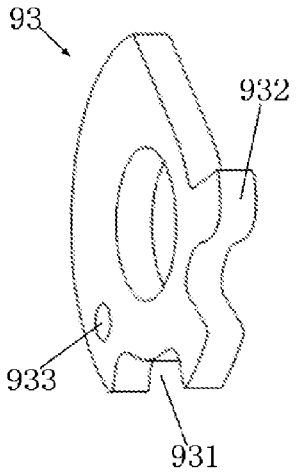
FIG. 6*d* is a perspective view of the second combination control disc of the combination control unit.
Figure 6E:
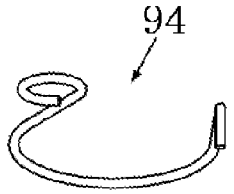
FIG. 6*e* is a perspective view of the return spring of the second combination disc of the combination control unit.

As depicted in FIGS. 2*a* and 2*b*, a positioning languet 61 is provided at one side of the reset plate 6. The positioning languet 61 may be formed with a plurality of positioning paws 62. Each positioning paw 62 may correspond to one first combination control disc 91. The positioning paw 62 may engage with one of the three positioning recesses 911, 912, 913 of the first combination control disc 91. For example, when the first combination control disc 91 is in an initial position, the paw 62 may engage with the first positioning recess 911. When the button unit 8 is pressed once, the first combination control disc 91 rotates through a predetermined angle. The paw 62 then engages with the second positioning recess 912 and holds the first combination control disc 91 in that position. When the button unit 8 is pressed again, the first combination control disc 91 rotates again through a predetermined angle and the paw 62 engages with the third positioning recess 913. When the paw 62 is engaged with a certain one of the positioning recesses 911, 912, 913 and the first reset spring 92 is resiliently deformed, then at this time if the positioning paw 62 is popped out and separated from the positioning recess, then first combination control disc 91 is reset under the action of the first return spring 92.

The specific structure of the mechanical combination lock has been described above with reference to the drawings. The operation of the mechanical combination lock will now be described below with reference to the drawings.

Figure 8A:
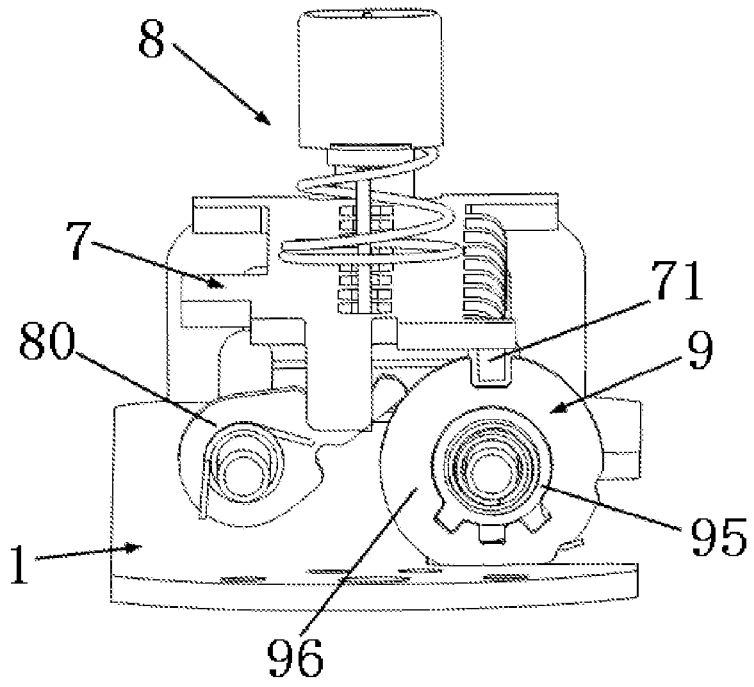
FIG. 8*a* is an end view of the mechanical combination lock in a condition when the combination is not set.
Figure 8B:
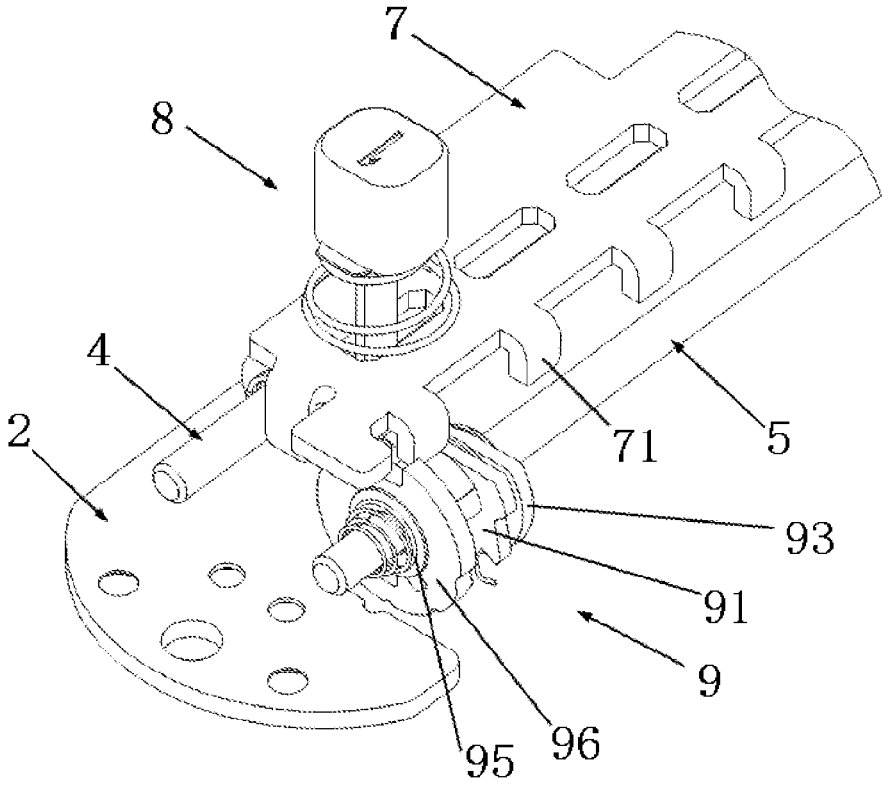
FIG. 8*b* is a partial perspective view of the mechanical combination lock in a condition when the combination is not set.
Figure 8C:
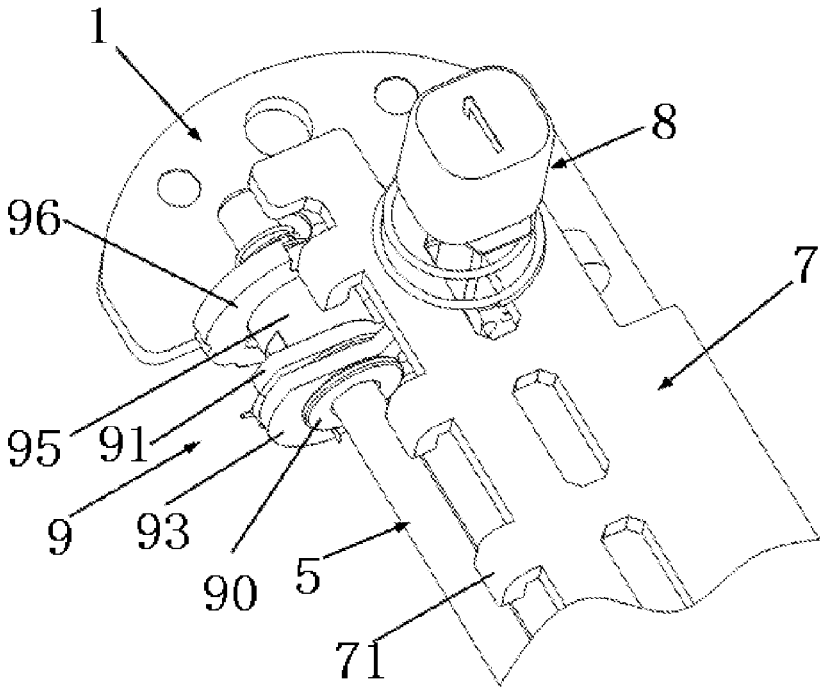
FIG. 8*c* is another partial perspective view of the mechanical combination lock in a condition when the combination is not set.

FIGS. 8*a* to 8*c* show the mechanical combination lock in a "non-combination" condition, i.e. a reset condition. In this condition, the control notches 965 of the combination discs 96 of the combination control unit 9 are aligned with the switching teeth 71 of the control plate 7, and the control plate 7 can be moved freely. The control notches 965 of the combination discs 96 are located in the respective first combination regions 961 of the combination discs 96.

Figure 9A:
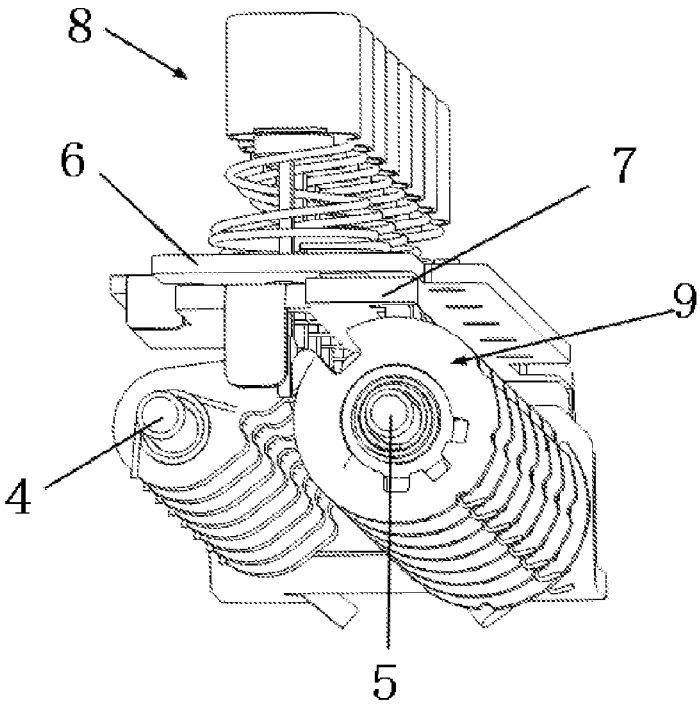
FIG. 9*a* is a perspective view of the mechanical combination lock in a combination setting condition.
Figure 9B:
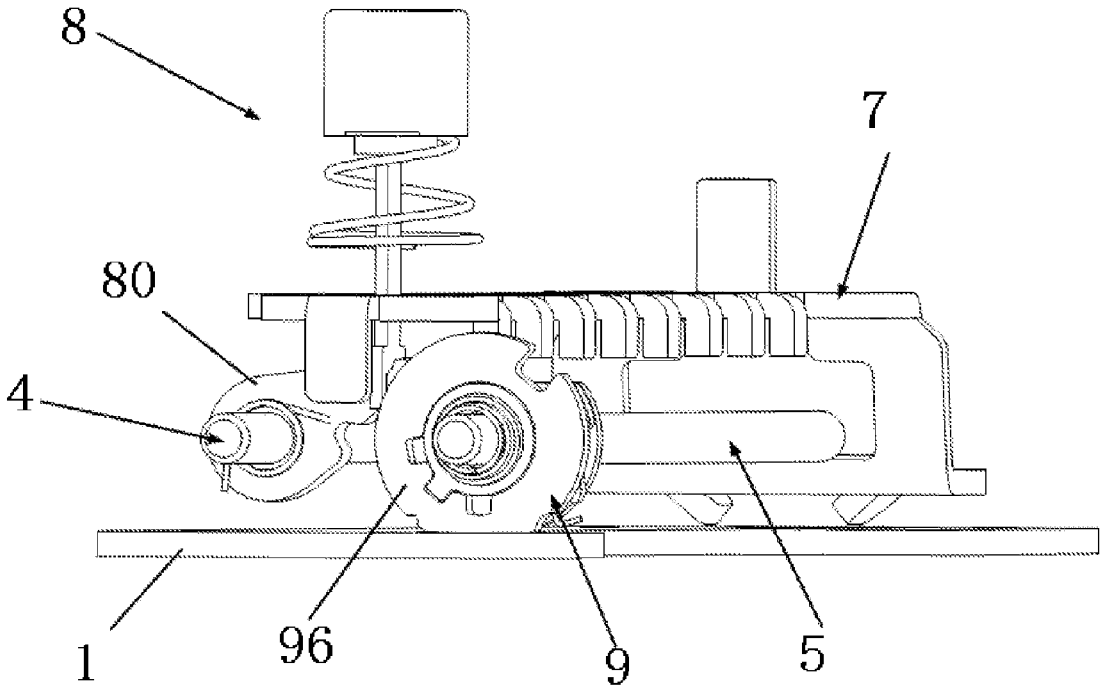
FIG. 9*b* is a perspective view of the mechanical combination lock in a locked condition.

Referring to FIGS. 9*a* to 9*b*, in order to set a 1-bit combination, one can start from a reset condition and can pull the coupling member 95 such that the protruding block 952 is released from the first combination region 961. Then the combination disc 96 can be turned so that the second combination region 962 is in alignment with the protruding block 952 of the coupling member 95. Then, one can release the coupling member 95 so that the protruding block 952 of the coupling member 95 enters into the second combination region 962 of the combination disc 96. At this moment, the control notch 965 of the combination disc 96 is no longer aligned with the switching teeth 71. The movement of the control plate 7 is restricted. In order to set a 2-digit combination, one can start from a reset condition and can pull the coupling member 95 such that the protruding block 952 is released from the first combination region 961. Then the combination disc 96 can be turned so that the third combination region 963 is in alignment with the protruding block 952 of the coupling member 95. Then, one can release the coupling member 95 so that the protruding block 952 of the coupling member 95 enters into the third combination region 963 of the combination disc 96. At this moment, the control notch 965 of the combination disc 96 is no longer aligned with the switching teeth 71. The movement of the control plate 7 is restricted.

To unlock a 1-digit combination when the positioning paw 62 of the positioning languet 61 is engaged with the first positioning recess 911 of the first combination control disc 91, one needs to press the button unit 8 once. When the button cap 84 is pressed, the driving fork 82 moves downwards and drives the cam portion 800 of the driving cam 80 to rotate through a predetermined angle. When the driving cam 80 is rotating, the cam portion 800 pushes the first swinging portion 917 of the first combination control disc 91 and rotates the first combination control disc 91 through a predetermined angle. The first combination control disc 91 drives the second combination control disc 93, and the coupling member 95 and then the combination disc 96 to rotate together. The rotation of the first combination control disc 91 stops when the positioning paw 62 is engaged with the second positioning recess 912, and is held in that position under the action of the positioning paw 62. This renders the control notch 965 of the combination disc 96 to rotate to a position that is aligned with the switching teeth 71, which is an unlocked position. When the button cap 84 is released, the button cap 84 springs upwards under the action of the button spring 85. The driving cam 80 rotates in an opposite direction under the action of the driving cam return spring 81 to thereby drive the driving fork 82 to its initial position. When the cam portion 800 of the driving cam 80 is returning to its initial position, it pushes the second swinging portion 932 of the second combination control disc 93 so that the second combination control disc 93 rotates in an opposite direction. When the cam portion 800 is released from the second swinging portion 932, the second combination control disc 93, under the action of the second reset spring 94, rotates to a position in synchronization with the first combination control disc 91. Not pressing or pressing the button unit 8 twice will not drive the control notch 965 of the combination disc 96 to a position in alignment with the switching teeth 71, and therefore cannot unlock the combination lock.

To unlock a 2-digit combination when the positioning paw 62 of the positioning languet 61 is engaged with the first positioning recess 911 of the first combination control disc 91, one needs to press the button unit 8 twice. When the button cap 84 is pressed the first time, the driving fork 82 moves downwards and drives the cam portion 800 of the driving cam 80 to rotate through a predetermined angle. When the driving cam 80 is rotating, the cam portion 800 pushes the first swinging portion 917 of the first combination control disc 91 and rotates the first combination control disc 91 through a predetermined angle. The first combination control disc 91 drives the second combination control disc 93, and the coupling member 95 and then the combination disc 96 to rotate together. The rotation of the first combination control disc 91 stops when the positioning paw 62 is engaged with the second positioning recess 912, and is held in that position under the action of the positioning paw 62. When the button cap 84 is released, the button cap 84 springs upwards under the action of the button spring 85. The driving cam 80 rotates in an opposite direction under the action of the driving cam return spring 81 and drives the driving fork 82 to its initial position. When the cam portion 800 of the driving cam 80 is returning to its initial position, it pushes the second swinging portion 932 of the second combination control disc 93 so that the second combination control disc 93 rotates in an opposite direction. When the cam portion 800 is released from the second swinging portion 932, the second combination control disc 93, under the action of the second reset spring 94, rotates to a position in synchronization with the first combination control disc 91. The second swinging portion 932 of the second combination control disc 93 rotates to the same horizontal position at the original position of the first swinging portion 917 of the first combination control disc 91.

When the button cap 84 is pressed again, the driving fork 82 moves downwards and drives the cam portion 800 of the driving cam 80 to rotate through a predetermined angle. When the driving cam 80 is rotating, the cam portion 800 pushes the second swinging portion 932 of the second combination control disc 93 and rotates the second combination control disc 93 through a predetermined angle. The second combination control disc 93 drives the first combination control disc 91, and the coupling member 95 and then the combination disc 96 to rotate together. The rotation of the first combination control disc 91 stops when the positioning paw 62 is engaged with the third positioning recess 913, and is held in that position under the action of the positioning paw 62. This renders the control notch 965 of the combination disc 96 to rotate to a position that is aligned with the switching teeth 71, which is an unlocked position. When the button cap 84 is released, the button cap 84 springs upwards under the action of the button spring 85. The driving cam 80 rotates in an opposite direction under the action of the driving cam return spring 81 and drives the driving fork 82 to its initial position. Not pressing or pressing the button unit 8 once will not drive the control notch 965 of the combination disc 96 to a position in alignment with the switching teeth 71, and therefore cannot unlock the combination lock.

The mechanical combination lock of the present application may further include an "always-open or passage" button, which may correspond to the letter "F". When one correctly enters a combination and then presses the "F" button, it can keep the mechanical combination lock in an always-open condition until that button is reset.

An embodiment of the mechanical combination lock has been described above wherein one button can set a combination having 2 or more bits. It is appreciated that a combination with more bits can be set by increasing the number of combination portions on the combination disc 96. For example, one can set a 3-bit combination when the combination disc 96 has four combination regions, and so on. By making use of the structure of this kind of button unit, one button can set a combination with 2 or more bits. This can greatly increase the complexity of the combination sequence and can prevent cracking of the combination sequence without increasing the number of buttons on the mechanical combination lock.

While the mechanical combination lock has been shown and described with particular references to a number of preferred embodiments thereof, it should be noted that various other changes or modifications may be made without departing from the scope of the appended claims.

What is claimed is:

1. A mechanical combination lock comprising a base having a cavity, a central shaft provided inside the cavity, and a plurality of combination control units provided on the central shaft, wherein each combination control unit comprises a combination disc having at least three combination regions that correspond respectively to different combination conditions;

the combination control unit further comprises a bottom seat and a coupling member both mounted on the central shaft, first and second combination control discs being mounted on the bottom seat, and first and second return springs for the resetting of the first and second control discs respectively; and the combination disc is coupled to the coupling member, and the first combination disc and the coupling member are coupled and rotatable together.

2. The mechanical combination lock as claimed in claim 1, wherein one side of the coupling member is formed with a protruding block for engagement with the combination disc, the protruding block being selectively engageable with one of the three combination regions so that the combination disc is disposed in corresponding combination condition.

3. The mechanical combination lock as claimed in claim 2, wherein the cavity is further provided with a control plate comprising a plurality of switching teeth, and each of the switching teeth corresponds to a control notch formed at a peripheral portion of the combination disc of one of the combination control units, and wherein the combination lock is in an unlocked condition when each of the switching teeth is aligned with the corresponding control notch, and the combination lock is in a locked condition when at least one of the switching teeth is offset with respect to the corresponding control notch.

4. The mechanical combination lock as claimed in claim 1, wherein the first combination control disc has three positioning recesses formed along a periphery thereof, one side of the first combination control disc facing the second combination control disc being formed with a position-limiting rod, the other side of the first combination control disc being formed with a connecting block for connection with the coupling member, the first combination control disc being formed with a first swinging portion.

5. The mechanical combination lock as claimed in claim 4, wherein the second combination control disc has an arc-shaped position-limiting notch formed at a periphery thereof, the position-limiting rod being located within the arc-shaped position-limiting notch, the second combination control disc being formed with a second swing portion.

6. The mechanical combination lock as claimed in claim 4, wherein a reset plate is provided inside the cavity, one side of the reset plate being provided with a positioning languet formed with a plurality of positioning paws, each of the positioning paws corresponding to the first control disc of one of the combination control units, each of the positioning paws being engageable with one of the positioning recesses of the corresponding first combination control disc.

7. The mechanical combination lock as claimed in claim 5, wherein a camshaft is further provided inside the cavity, and a plurality of button units is provided above the camshaft, each button unit corresponding to one of the combination control units.

8. The mechanical combination lock as claimed in claim 7, wherein the button unit comprises a driving cam and a driving cam return spring, the driving cam being formed with a cam portion for pushing the first and second swinging portions.

9. The mechanical combination lock as claimed in claim 8, wherein the button unit further comprises a driving fork provided between an internal member and the driving cam, the driving fork engaging with a recess formed on the driving cam, the internal member being mounted at an upper end of the driving fork, a button cap being mounted on top of the internal member, and a button spring being coupled with a cylindrical portion of the internal member.

* * * * *